United States Patent [19]

Funk

[11] 3,961,781

[45] June 8, 1976

[54] FOLDABLE-SHEET PROCESSING SYSTEMS

[75] Inventor: Roger S. Funk, Holicong, Pa.

[73] Assignee: R. Funk & Co., Inc., Doylestown, Pa.

[22] Filed: Feb. 23, 1973

[21] Appl. No.: 335,020

Related U.S. Application Data

[63] Continuation of Ser. No. 873,454, Nov. 3, 1969, abandoned.

[52] U.S. Cl. ..... 270/20; 270/62; 270/67

[51] Int. Cl.[2] ..... B41F 13/56

[58] Field of Search ..... 270/1, 4, 5, 20, 62–67, 270/68, 69, 45, 58; 209/73, 111.7; 101/82, 2, 233

[56] References Cited

UNITED STATES PATENTS

| | | | |
|---|---|---|---|
| 2,807,463 | 9/1957 | Smith | 270/20 |
| 3,467,370 | 9/1969 | Grantham | 270/85 |
| 3,467,371 | 9/1969 | Britt et al. | 270/58 |
| 3,698,705 | 10/1972 | Funk et al. | 270/62 |

*Primary Examiner*—Edgar S. Burr
*Assistant Examiner*—A. Heinz
*Attorney, Agent, or Firm*—Synnestvedt & Lechner

[57] ABSTRACT

The disclosure involves systems for processing foldable sheets, especially prints made from reproducibles of different characteristics (for example, of different sizes, shapes, and other categories), said systems comprising methods or techniques, as well as apparatus; and in a typical sheet-processing system there is a coordination of printing, conveying, alining, sensing, marking, folding, sorting and stacking of flexible sheets such as blueprints or the like — mostly or entirely in an automatic manner. Typical equipment embodying and operating according to the invention may include:

- Combined mechanism for positioning sheets and conveying them between work stations;
- A sheet printer, preferably with sheet-indexing means;
- Printed-sheet-recognizing means, which may sense the presence, size and/or other characteristics of the sheet;
- Marking, folding, sorting, discharging and stacking devices, preferably with programming mechanism, wholly or partially subject to said sheet-recognizing means;
- Power drive means for the equipment, with automatic controls and manual over-ride devices.

20 Claims, 26 Drawing Figures

INVENTOR
ROGER S. FUNK
BY Symmetred A. Ledner
ATTORNEYS

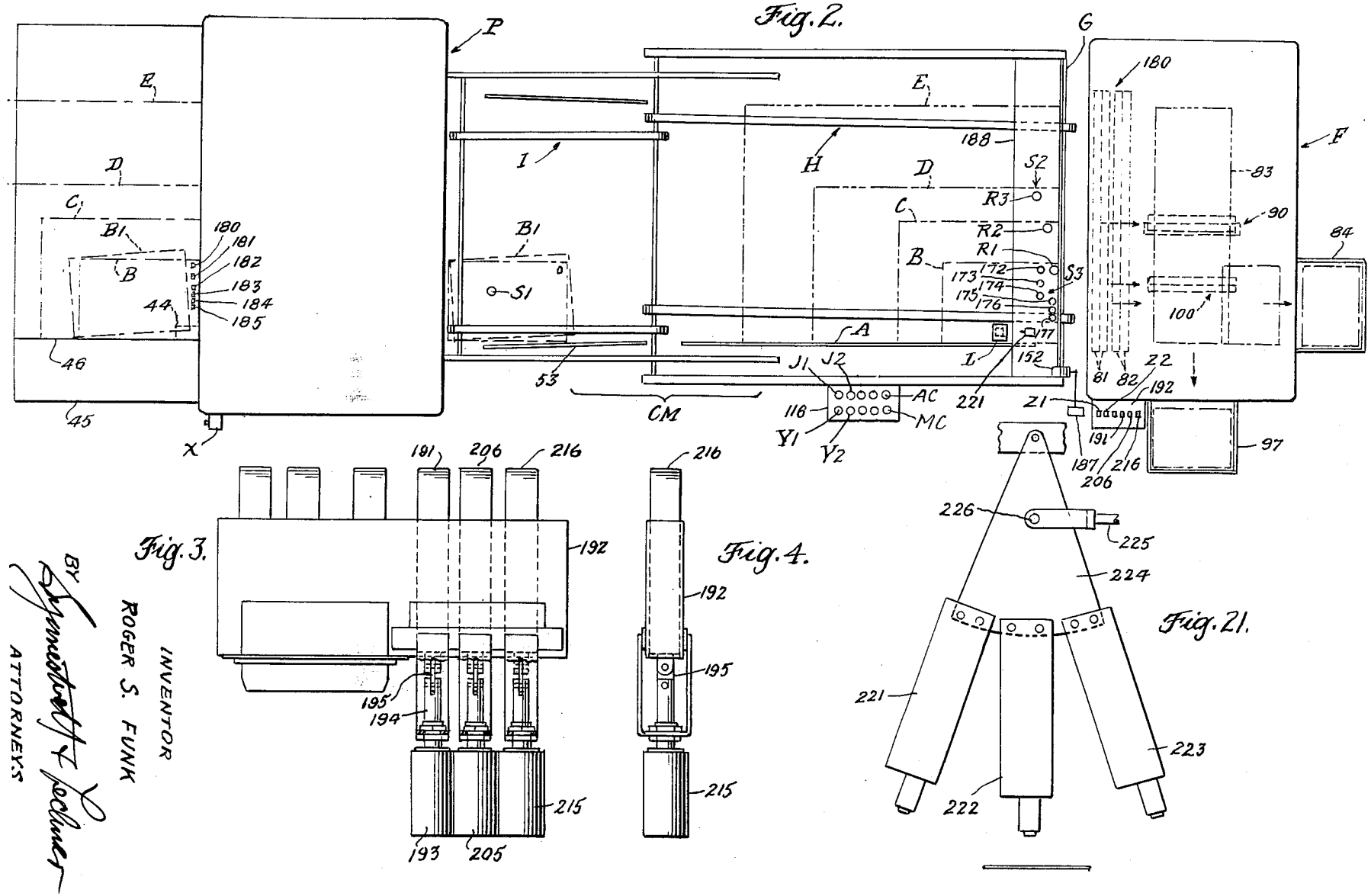
INVENTOR
ROGER S. FUNK
BY Symmestvedt & Lechner
ATTORNEYS

INVENTOR
ROGER S. FUNK
BY
ATTORNEYS

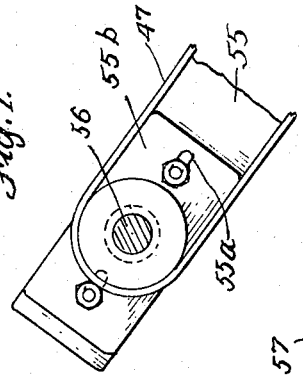
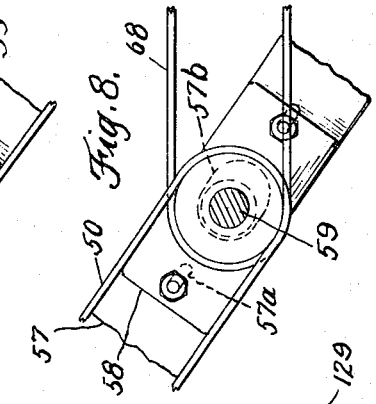
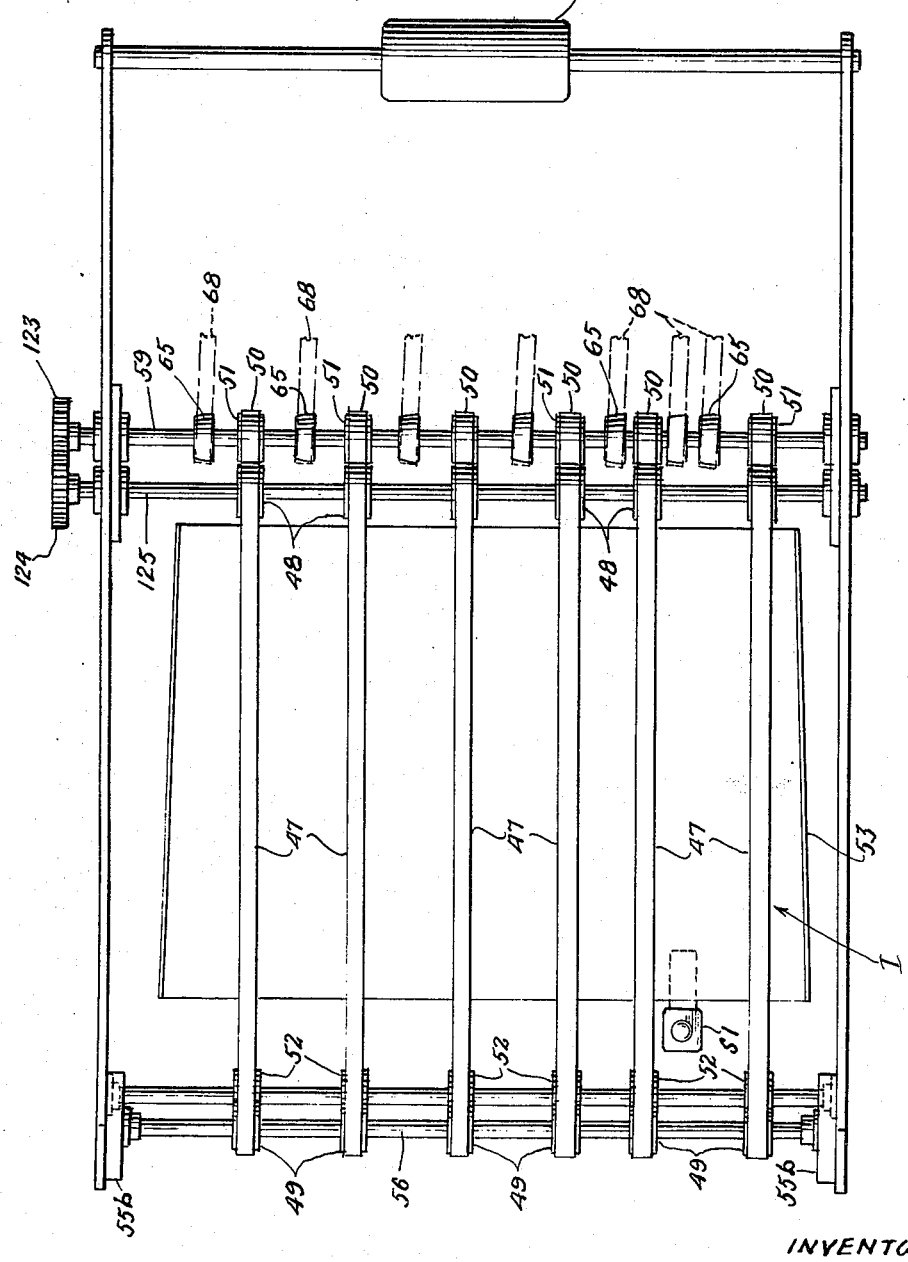
INVENTOR
ROGER S. FUNK
BY Symmes, Martin & Lechner
ATTORNEYS INVENTOR
ROGER S. FUNK
BY Symmes, Hart & Pechner
ATTORNEYS

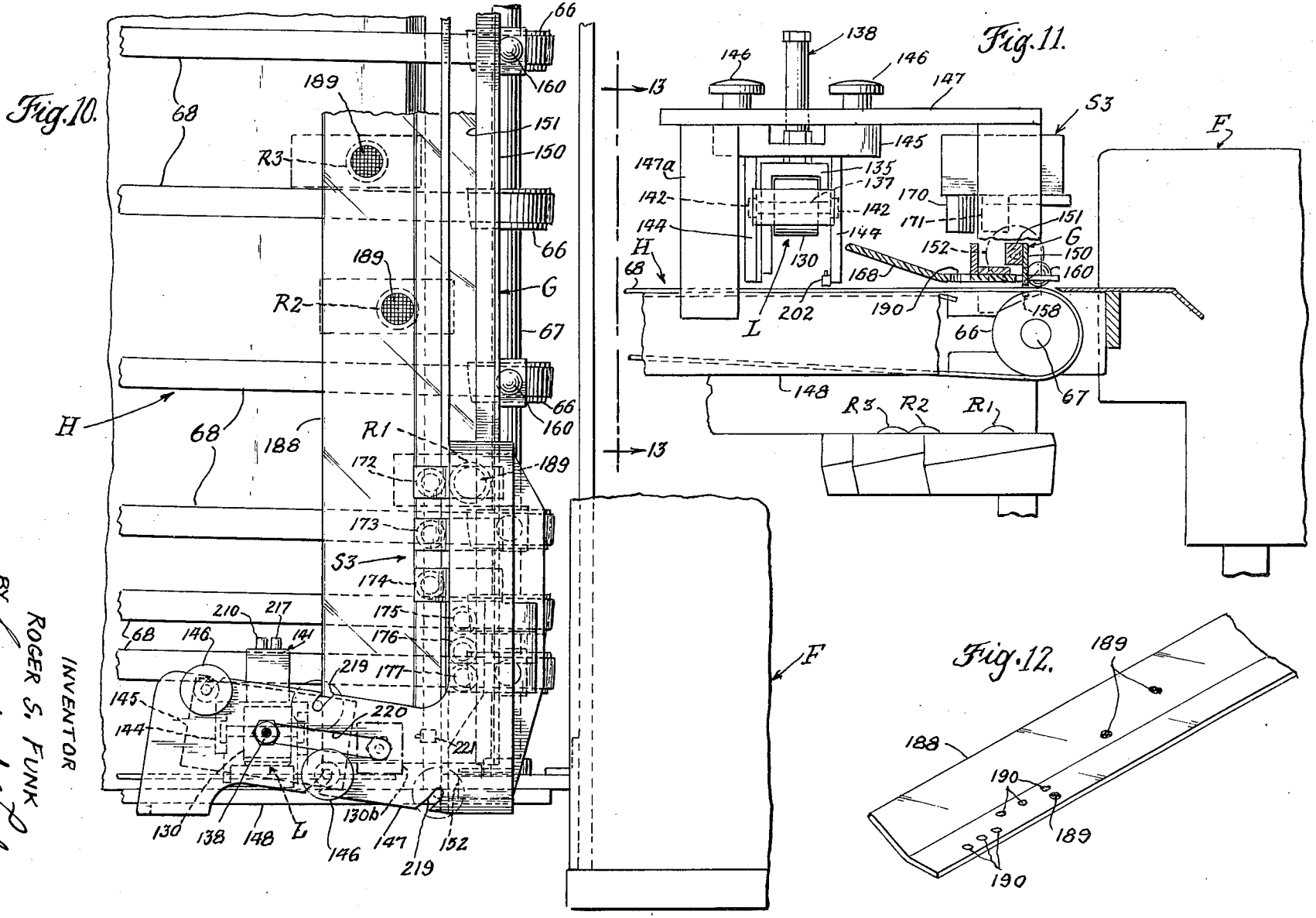
INVENTOR
ROGER S. FUNK
BY Symmes Hadley & Lechner
ATTORNEYS

INVENTOR
ROGER S. FUNK
BY Symmes Hall & Pechner
ATTORNEYS

INVENTOR
ROGER S. FUNK
BY Symmes Hadley & Lechner
ATTORNEYS

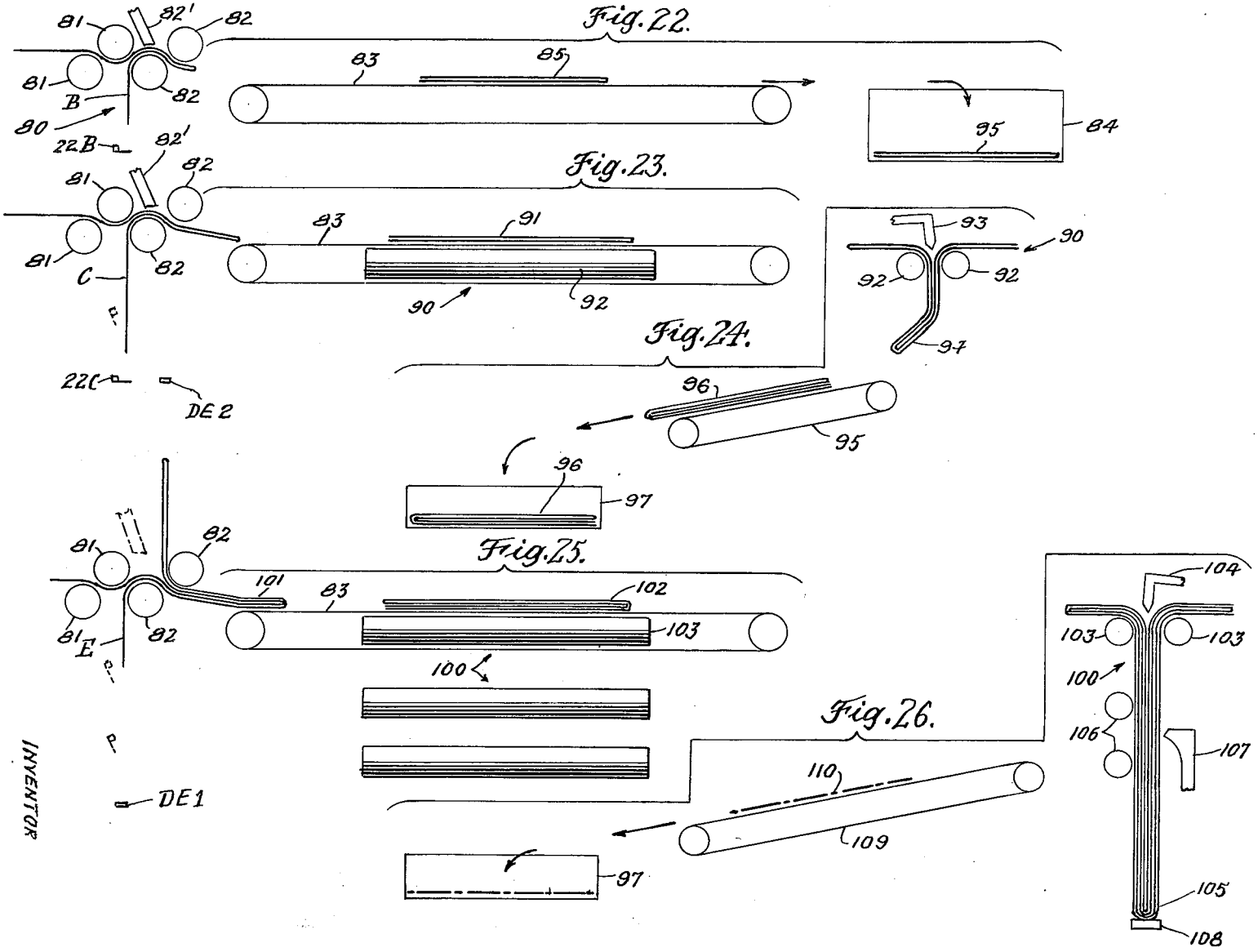
INVENTOR
ROGER S. FUNK
BY Symmes Hadden & Lechner
ATTORNEYS

FOLDABLE-SHEET PROCESSING SYSTEMS

This application is a continuation of Applicant's prior abandoned application, entitled as above, Ser. No. 873,454, filed Nov. 5, 1969.

This invention relates to foldable-sheet processing systems, being especially useful in the processing of paper sheet duplicates of drawings, tracings or other reproducibles, and the invention involves both a method of processing foldable sheets and equipment for practicing the method.

Herein, both the method and the equipment are referred to, broadly, as foldable-sheet processing systems; and the term processing a sheet, except where otherwise limited expressly or by clear implication, is used broadly to include one or more of such operations (with respect to the sheet) as supplying, printing, indexing, discharging, scanning, conveying, positioning (either by bodily movement, or turning about an axis, or both), arresting the movement, recognizing one or more characteristics, labelling or otherwise marking, releasing, folding, sorting, discharging, and stacking; and the invention further involves methods and equipment whereby one or more such operations may be performed automatically and in a substantially continuous manner.

The principal object of the invention is to simplify, facilitate, speed-up, and render more accurate, reliable and economical, the processing of foldable sheets, and more particularly the printing, conveying, marking, folding, sorting and stacking of blueprints, whiteprints and other copies of any form of reproducibles, whether such copies be of one size and shape or an intermix of a variety of sizes and/or shapes.

Although various of the operational steps of such a processing system may be done by hand, or be controlled manually, it is preferable, in the practice of this invention, to effect most if not all of the operations by means of automatic equipment, substantially continuously operating, although various components thereof are capable of manual operation also.

How the principal object of the invention, and such other objects as will appear to those skilled in this art as this description proceeds, are achieved, will be set out in connection with the disclosure of the presently preferred equipment embodying and operating according to the invention. Such equipment includes combinations of two or more of the following:

Mechanism for positioning a sheet properly, relative to a work station;

Mechanism for conveying a sheet from one station to another;

A combined sheet-conveying and positioning mechanism;

A sheet-printer, adapted to print sheets from a reproducible and/or to apply index markings to such sheets;

Sheet-sensing or recognizing apparatus, which, in the preferred embodiment, senses the presence of a sheet, the category of the sheet and the size of the sheet;

A sheet-folder, adapted to receive sheets from the conveying and/or positioning mechanisms;

Programming means adapted to condition the folder, as by selecting the folding units thereof, to handle sheets of different sizes and to sort them for distribution to different stacking stations, such programming means being part of or controlled by the sheet-sensing apparatus;

a sheet-labelling or identifying device, the operation of which is related to the category of the sheet as found by the sensing apparatus;

Drive means for one or more of the foregoing;

Control means for such drive means;

Manual and automatic actuators for various parts of the equipment;

A sheet-actuated automatic start-up device, preferably with a timer shut-off;

Sheet arresting means adapted to hold a sheet, for an interval, during operation of the sheet-labelling or identifying device;

A sheet-printer, adapted to print sheets from a reproducible, with or without index means for subsequent labelling or identifying of the sheets, and having an outlet for the successive discharge of printed sheets of varying sizes;

Conveyor mechanism between the printer (at one work station) and the folder (at another work station), said mechanism being adjustable to accommodate differing relative positions of the printer outlet and folder inlet;

Sorting or distributing means embodied within the folder, and packet receivers for stacking folded print packets of predetermined size or sizes;

Quick stop and start devices whereby one attendant can close down the system in case trouble develops with any component thereof, and can restart the system when it is in good order.

In effectuating the objects of the invention, and obtaining its advantages, especially in connection with the reproduction of drawings, tracings, or the like, it should be kept in mind that in designing, engineering, architectural, and other offices, manufacturing plants, and the like, it is quite customary to employ efficient, and more or less automated, printing machines, to make blueprint, whiteprint, xerographic, or other, copies of drawings and various other documents. Machines for the folding of prints to one or another standardized size are also coming into use. But in the overall processing of prints there have been production inhibitors, bottlenecks and the like, which greatly interfere with the overall efficiency and reliability of the installation, and thus also keep the costs too high.

For example, an attendant may operate the printer and feed tracings and paper into it; another attendant may transport the prints to the general location of a folding machine; and still another may operate that machine, and, if the prints are of various sizes, it may be necessary to pre-sort them, and either deliver them to different machines for folding (depending upon size) or manually set up the machine from print to print to handle the different sizes; and, if the prints are to be marked, either with labels or legends, notches, or other identification — for example, to indicate on the prints certain pre-established categories of the drawings from which they are made, it may be necessary to have a fourth operator to do this labelling, or marking, either before or after the folding. Furthermore, the step, unit or person which is the slowest in the processing system will tend to set the pace for the whole system.

In accordance with the present invention, all parts of the equipment can be coordinated, run at a rapid and efficient rate, and be operated by one attendant.

The equipment embodying the invention to its fullest extent will normally incorporate all of the features and elements hereinabove mentioned and various details which will later appear.

How the foregoing, and various other objects and advantages are attained will become apparent as this description proceeds with reference to the accompanying drawings, wherein:

FIG. 2 is a diagrammatic plan view of the equipment;

FIG. 3 is an elevational view of a control console utilized in the equipment;

FIG. 4 is an end view of FIG. 3;

FIG. 6 is a plan view of the inclined conveyor, taken as indicated by the arrows 6—6 of FIG. 5, showing also a portion of the horizontal conveyor;

FIGS. 7 and 8 are detailed fragmentary views of the belt adjusters of the inclined conveyor;

FIG. 10 is a fragmentary enlarged plan view of the right hand end portion of the horizontal conveyor, showing also a portion of a sheet-folder;

FIG. 11 is a fragmentary elevational view of FIG. 10,

FIG. 12 is an isometric view of a print or sheet guide of the horizontal conveyor, which cooperates with the skewed belts of said conveyor in properly positioning the sheet for entry into the folder;

FIG. 21 is a more or less diagrammatic view of a simple, alternative form of imprinter;

FIG. 22 is a view diagrammatically illustrating a folding unit of the sheet-folder for folding sheets, such as prints, of one size into packets of given dimensions;

FIGS. 23 & 24 are views diagrammatically illustrating a second folding unit of the sheet-folder for folding sheets of larger size into such packets; and FIGS. 25 & 26 are similar views illustrating a third folding unit for folding sheets of still larger sizes into such packets.

Figure 1:
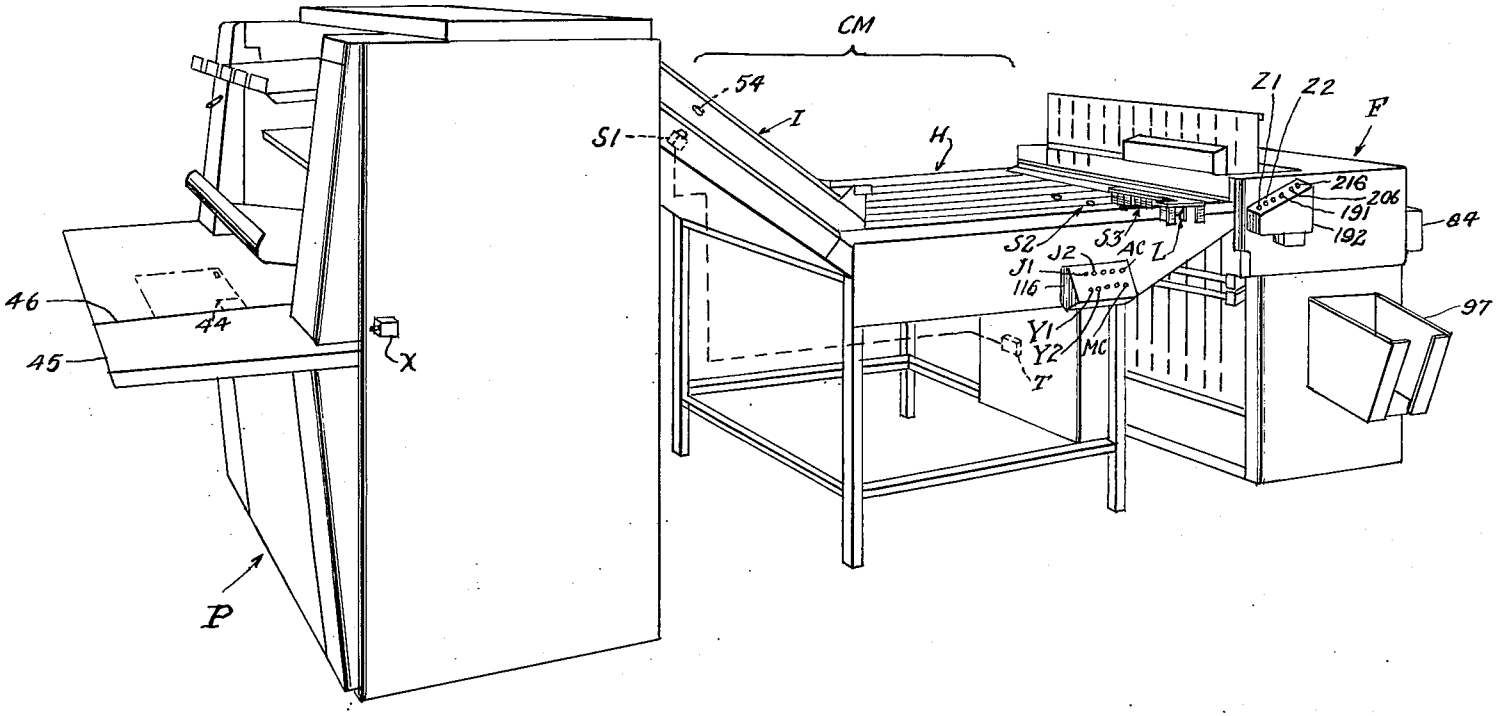
FIG. 1 is a perspective view of the presently preferred equipment embodying and operating according to the systems of the present invention.

Before describing the system in detail, a typical field of use will be referred to and the general arrangement of various components of the presently preferred equipment will be mentioned.

By way of example, but not limitation, the system according to the present invention is of especial use in connection with the production, marking, and folding, of prints of drawings of various sizes into folded packets of a given, predetermined size. For instance, in such a system, prints known as B, C, D and E sizes (which are customarily 11 inches × 17 inches, 17 inches × 22 inches, 22 inches × 34 inches and 34 inches × 44 inches; are folded into standardized packets of 8½ inches × 11 inches. As another example, prints variously ranging in size from 12 inches × 18 inches up to 36 inches × 48 inches may be folded into a standardized 9 inches × 12 inches packet. With the equipment employed, the title block will always appear on the top panel of the final folded packet.

In the typical system, the printing machine (which may, for example, be a diazo printer for making blueprints or whiteprints from tracings, or a xerographic machine, or any other suitable printer) has an outlet adapted to deliver prints to the conveyor mechanism of the system, and, in association with this mechanism, or as part of such mechanism, the equipment includes print arranging or positioning means adapted to dispose the prints of various assorted sizes, in their progress from one work station to a second work station, for proper entry into a folding machine. Thus, the printer may be considered as located at the first station, and the folder as located at the second station. Desirably, the folding machine may be of the type disclosed and claimed in the co-pending Funk U.S. Pat. Application No. 737,934, filed June 18, 1968, or such other machines as may be available and compatible with the other features of the present system as herein disclosed. Those folding units and other elements of the preferred folding machine, forming a cooperative portion of the preferred system of the present invention, are illustrated herein partly diagrammatically, in their relation to other parts of the equipment, with which they function in a substantially continuous and automatic fashion.

Further in this typical system, the cycling or programming of the sheet folder is done automatically under the guidance or control of a portion of the sheet-sensing or recognizing apparatus, which in the preferred embodiment includes means for sensing the presence of a sheet entering the conveyor mechanism, means sensing the category of the sheet and means sensing the size of the sheet; the first-mentioned means being adapted to automatically start and stop some portions or all of the equipment; the second-mentioned means being adapted to effect labelling, identification or other marking of a sheet (according to the category of the tracing or the like from which the sheet was printed) and the third means being adapted to program the operation of the folder, which, in turn, will automatically fold, sort and distribute the sheets as folded packets into a plurality of stacking receivers, or the like. Typically also, the equipment is provided with sheet retarding or arresting means adapted to facilitate operation of one or more of the sensing means and/or the folder-programming means and/or the sheet labelling or identifying device. Further, the sheet-transporting or conveying mechanism may be employed additionally to accommodate differences in position, such as differences in level of the printer outlet and the folder inlet; for example, by an adjustably inclined conveyor, or in cases of extreme differences in elevation (for instance, where the printer outlet is located much higher than the folder inlet), the invention provides for the use of a declined conveyor leading downwardly from the printer outlet, and a substantially horizontal conveyor extending from the lower end of the declined conveyor to the inlet of the folder.

Typically, the horizontal portion of the conveyor mechanism may embody means for positioning the print for entry into the folder, and properly align it laterally regardless of the size of the print, and irrespective of whether the print emerged from the printer in its proper alignment or in a skewed position or laterally displaced.

The foregoing and other features are typical of equipment for the field of use of the invention in a continuous automatic print system for making, marking and folding prints of various sizes and categories and stacking them as standardized packets.

Referring to the drawings, the preferred equipment in general includes a printer P for making prints from tracings; conveyor mechanism CM, which here includes an inclined conveyor I for receiving prints from the printer and for feeding the prints to a generally horizontal conveyor H; a folding machine F; relfex or retro-reflective scanner means S1 adjacent the print receiving end of the inclined conveyor I, which scanner, when its light beam is interrupted by a print fed from the printer P to the conveyor, starts the conveyor mechanism CM and the folder F; a timer T of known form, associated with the scanner S1, typically adjustable to time out in from one-half minute to five minutes, and adapted to shut the system off if a succeeding print does not interrupt the light beam within the time-limit setting of the timer, and to automatically start the system again when a print next intercepts the light beam; a print aligner A cooperating with parts of the conveyor mechanism for correctly positioning the prints for entry into the folder F; print-size-activated scanner means S2, comprising three reflex photoelectric relays R1, R2 and R3, for selecting one or more folding units or mechanism of the folding machine F appropriate for folding the particular print actuating the selector means; and imprinter or labeller L for imprinting one of several different legends or the like on the prints; an identification index scanner S3 (FIGS. 1, 2 and 9 to 11) comprising photoelectric devices for controlling or indexing the imprinter or labeller L to selectively print different legends on the prints; and a normally closed-gate-mechanism G for momentarily stopping each print as it reaches the area of scanner S3, and holding it at rest until recognition and imprinting are accomplished, whereupon the gate G opens to allow the imprinted print to pass on into the folding machine F.

The printer P for making the prints from tracings may well be a diazo printer of known form, and may include a front feed table 45 having a longitudinal guideline 46 with which the adjacent edges of the print paper and tracing are normally to be aligned, and a rear exit opening from which the prints emerge for delivery to the inclined conveyor I.

Figure 5:
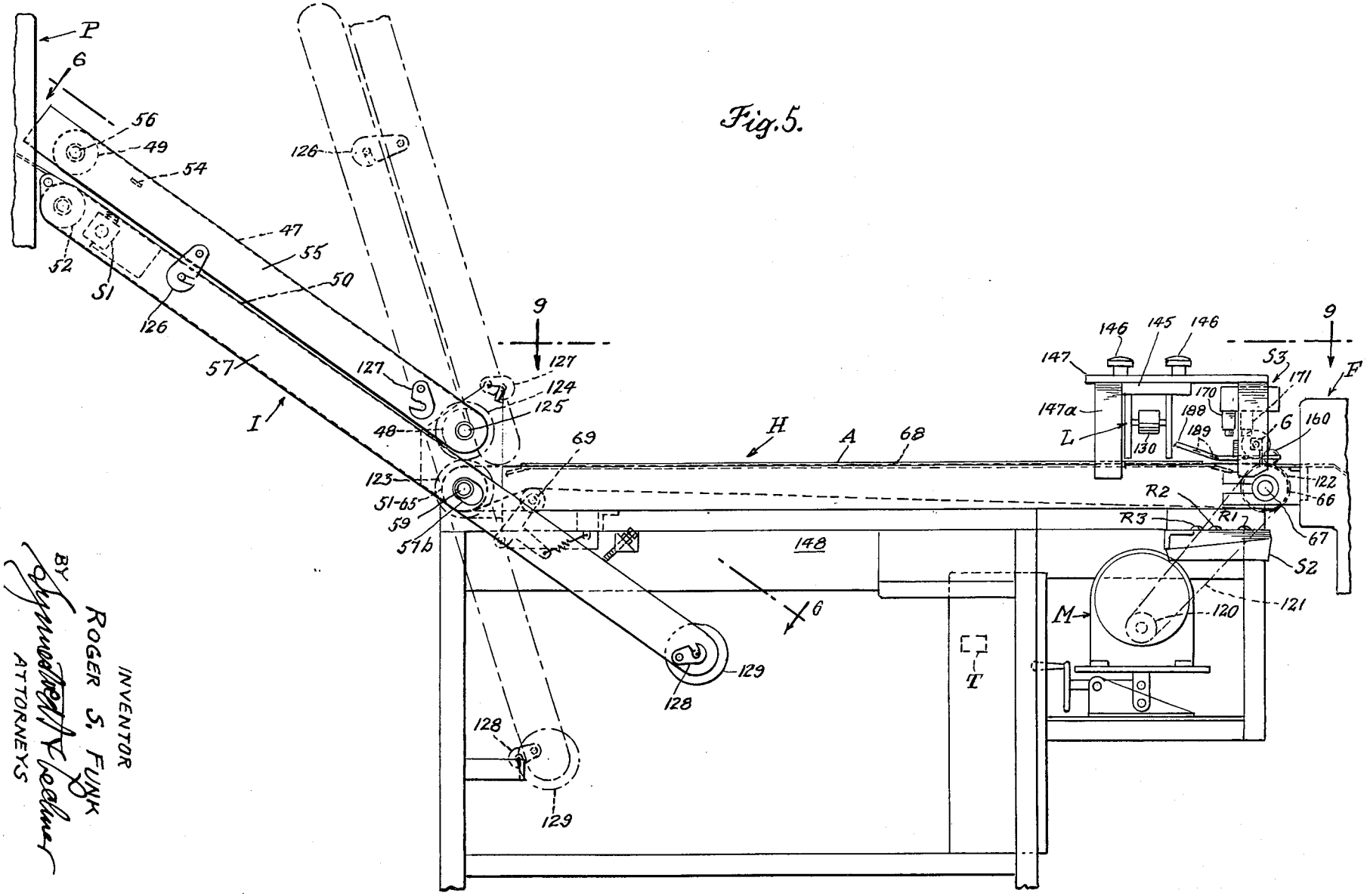
FIG. 5 is a side elevation of a conveyor mechanism constituting a portion of the equipment, which in this embodiment includes an inclined and a substantially horizontal conveyor.

Referring particularly to FIGS. 5–9, the inclined conveyor I includes a series of upper laterally spaced belts 47 and pulleys 48 and 49; a series of lower laterally spaced belts 50 and pulleys 51 and 52; a suitable guide plate 53 for the prints; and the retro-reflective scanner S1 (also termed reflex scanner) which is mounted beneath the upper run of the lower belts and which has a retro-reflective button 54 mounted thereabove as indicated in FIG. 5 so that a print entering between the conveyor belts 47 and 50 will interrupt the light beam to start the conveyors, and preferably also other parts of the system, as will later be described. The lower belts 50 transport the prints and the upper belts 47 hold them in position. Any slack developing in the upper belts 47 is taken up by adjusting the bearing blocks **55*b* of the pulley shaft 56 upwardly in the frame 55 (FIGS. 5 to 7), as accommodated by slots 55*a* in said blocks. Any slack developing in the lower belts 50 is taken up by adjusting the frame 57 of the lower belts upwardly (FIG. 8) relative to the fixed bearing blocks 58, it being noted that the blocks 58 carrying the fixed pulley shaft 59 do not shift when adjustment is made. The frame 57 has slots 57*a*, 57to** accommodate the adjustments.

The horizontal conveyor H includes laterally spaced pulleys 65 secured on the shaft 59, correspondingly spaced pulleys 66 secured on the parallel drive shaft 67 and belts 68. Slack in the belts 68 is taken up by spring-biased individual tensioning rollers 69.

Figure 9:
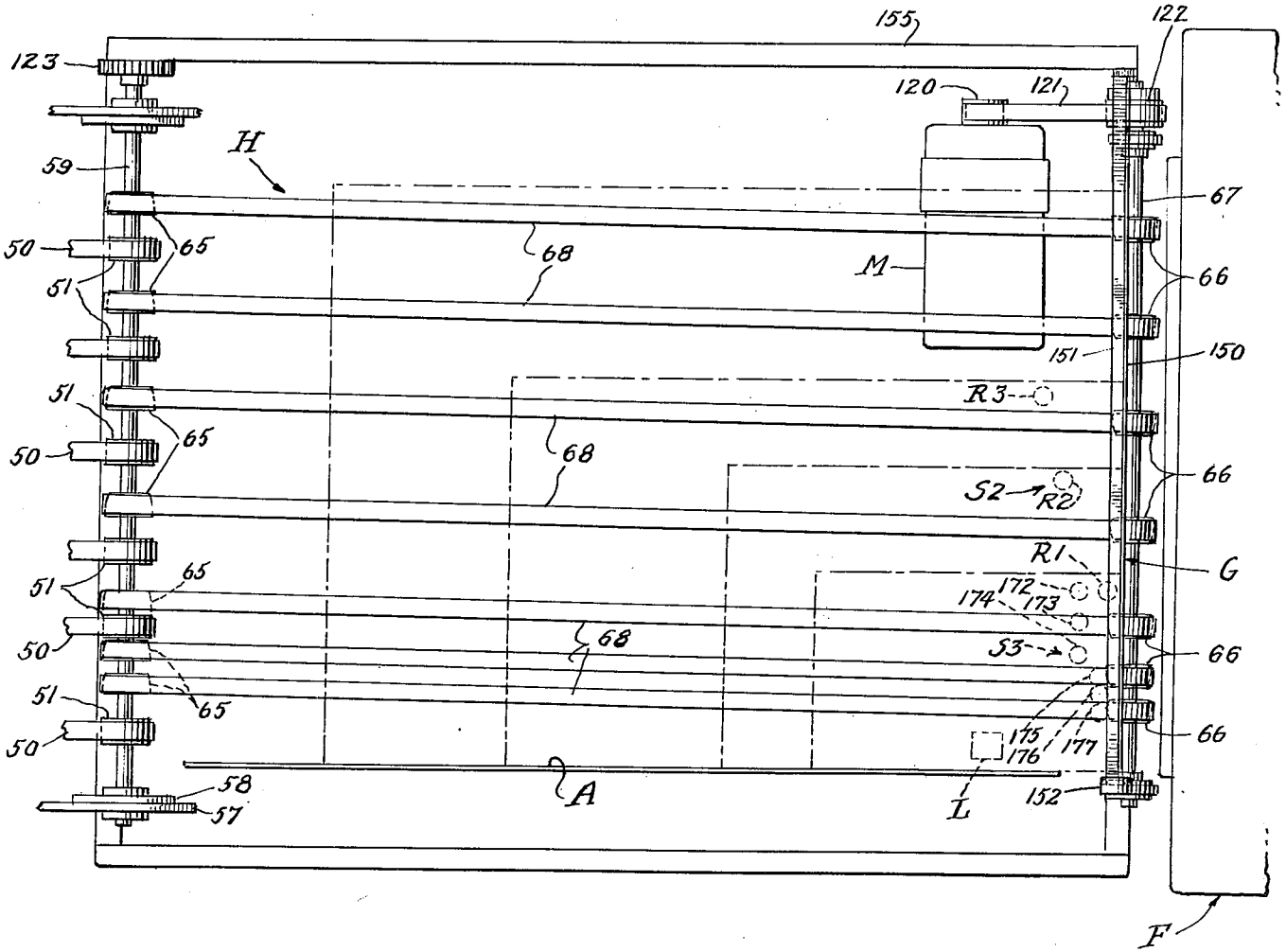
FIG. 9 is a plan view of the horizontal conveyor taken as indicated by the arrows 9—9 in FIG. 5.

Referring particularly to FIG. 9, it is to be observed that the drive pulleys 66 of the drive shaft 67 are offset with relation to the pulleys 65 of the parallel shaft 59, and that the pulleys 65 and 66 are so contoured as to cause the belts to track at an oblique angle toward a fixed horizontal guide member or print aligner A on the framework of the horizontal conveyor (as also seen in FIG. 2), thus causing the side edge of the prints being conveyed to contact the guide member so as to be properly positioned and fed squarely into the folding machine F. Thus, even if a print should be inadvertently fed askew into the printer (or so emerge therefrom), as illustrated for example at $B^1$, it will be properly positioned and aligned when it reaches the entrance of the folder F (as shown by print B at the right of FIG. 2).

The mounting, on shaft 59, of the pulleys 65 of the horizontal conveyor H and of the pulleys 51 of the inclined conveyor I will be seen to be mostly alternating, in side-by-side relation, as is clearly shown in FIGS. 6 and 9.

The preferred print folding machine F (disclosed fully in co-pending application 737,934, and diagrammatically herein) includes a first folding unit or mechanism 80, diagrammatically illustrated in FIG. 22 and comprising in general a pair of feed rolls 81, 81, located at the inlet throat of the folding machine, an adjacent pair of creasing rolls 82, 82, a selectively-actuable stop 22B and gate $82^1$, a horizontal conveyor 83 extending from the vicinity of the creasing rolls rearwardly to the back of the folding machine and a rear packet receiver or tray 84. This first unit, when selected, in a manner hereafter appearing, to fold a B-size print into a packet of 8½ inches × 11 inches size, is adapted to transversely fold the print in half and feed it onto the conveyor 83 as shown at 85 in FIG. 22. The conveyor 83 then feeds the packet into the stacking tray 84.

The print folding machine also includes a second folding unit or mechanism 90, diagrammatically illustrated in FIGS. 23 and 24 for cross-folding a C-size print into an 8½ inch × 11 inches packet after it was transversely folded in half by the rolls 81 and 82. A selectively-actuated stop 22C and gate $82^1$ comes into play, and the folded sheet is delivered onto the conveyor 83 as shown at 91. The diagram of FIG. 24 may be considered a view at right angles to FIG. 23, viewed from the right of FIG. 23. The cross-folding mechanism includes a pair of creasing rolls 92, 92, the axes of which are disposed at right angles to the axes of the rolls 81 and 82, and an associated creasing blade 93 for tucking the transversely folded print 91 into the nip of the rolls 92, 92, to crossfold the print after which it is fed downwardly as shown at 94 and then onto an inclined conveyor 95 as shown at 96 as a once transversely folded and once crossfolded packet of 8½ inches × 11 inches size. The conveyor 95 then delivers the packet 96 into a stacking receiving tray 97.

In addition, the folding machine includes a third folding unit or mechanism 100 diagrammatically illustrated in FIGS. 25 and 26, and including fixed stops DE1 and DE2, for crossfolding an E-size print into an 8½ inches × 11 inches packet after it was twice transversely folded by the rolls 81 and 82, as shown at 101, and delivered onto the conveyor 83 as shown at 102. The cross-folding mechanism includes a first pair of creasing rolls 103, 103, the axes of which are at right angles to the axes of the rolls 81 and 82, and an associated creasing blade 104 for tucking the transversely folded print into the nip of the rolls 103, 103, to make a first crossfold 105 of the print, after which it is fed downwardly past a second pair of creasing rolls 106, 106, and an associated creasing blade 107 to a bottom stop 108. The creasing blade 107 then tucks the once crossfolded print into the nip of the rolls 106, 106, to effect a second crossfold, and the print, now folded into an 8½ inches× 11 inches packet, is delivered onto a conveyor 109 as indicated by the dot-and-dash line 110 and the packet is then delivered into the tray 97.

Referring now to the folding of a 22 inches × 34 inches D-size print, and in fact any size ranging from 22 inches × 34 inches D-size to 34 inches × 44 inches E-size, the transverse folds and crossfolds are accomplished in the same manner as above described in connection with the 34 inches × 44 inches E-size print.

The above operations obviously include automatic sorting and distributing of prints into the receivers 84 and 97.

Having thus generally described the main components of the system, I will now describe the arrangement, functioning and construction of the components of the system in greater detail.

The horizontal conveyor H is driven by means of a motor M (FIGS. 5 and 9) drivingly connected by a drive pulley 120 and belt 121 to a driven pulley 122 secured on the drive shaft 67 of the horizontal conveyor, and the lower belts 50 of the inclined conveyor I are driven by the horizontal conveyor pulleys 66, belts 68, pulleys 65, shaft 59 and pulleys 51. The upper belts 47 of the inclined conveyor are driven by a gear 123 secured on the shaft 59 of the lower belts which gear (as shown in FIG. 6) meshes with a gear 124 secured on the drive shaft 125 carrying the pulleys 48 of the upper belts.

It is to be noted that in order to give ready access to the rear of the printer P the inclined conveyor (comprising the upper and lower frames 55 and 57) is pivotally mounted to the shaft 59 so that it can be swung to the upward position indicated in dot-and-dash lines in FIG. 5. Suitable holding latches 126 and 128 are provided for this purpose, and the conveyor is counterweighted at 129 for ease of operation. The upper frame 55 can be separately pivoted about axis 125 (for example, to clear a paper jam between the sections of the conveyor) and held by latch 127.

The imprinter may be of a form shown in FIGS. 17 to 20, or alternatively of a form shown in FIG. 21. In the form shown in FIGS. 17–20, there is in this instance a three-position rotary imprinting head 130 carrying three printing blocks 131, 132, 133, preferably made of vinyl, for imprinting three different legends, identifications or messages on the prints in accordance with the selection made in a manner presently appearing. The imprinter also comprises inking roller 134; a carrier 135 having bearings 136, 136, for the shaft 137 of the rotary head 130; a piston and cylinder device 138 for imparting up and down movement to the head 130, a pinion 139 and rack 140 for imparting rotary motion to the rotary head 130; and stop mechanism associated with the head generally indicated by the numeral 141.

Figures 17, 18, 19, 20:
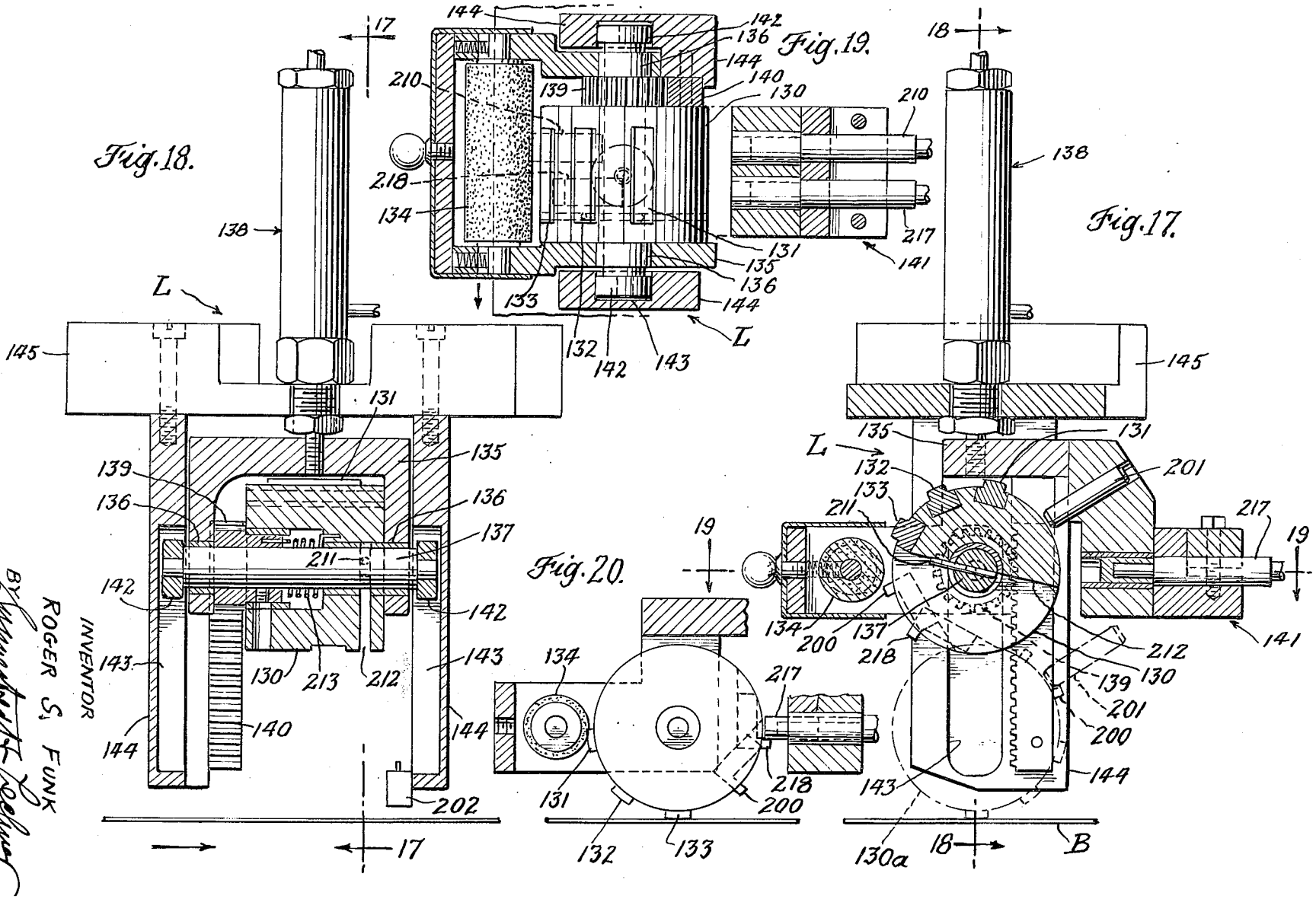
FIG. 17 is a sectional elevational view of a labelling or marking imprinter employed in the equipment, the view being taken on the line 17—17 of FIG. 18.
FIG. 18 is a cross-section taken on the line 18—18 of FIG. 17.
FIG. 19 is a plan section taken on the line 19—19 of FIG. 17.
FIG. 20 is a detailed fragmentary view showing the printing roll of the imprinter of FIG. 17 in a printing position.

As best seen in FIGS. 17, 18 and 19, the rotary imprinting head 130 is guided in its up and down movement by means of rollers 142, 142, mounted at the ends of the shaft 137 operating in elongated guiding grooves 143, 143, of the fixed brackets 144, 144, depending from the mounting plate 145, which plate is adjustably secured by thumb screws 146, 146, (FIGS. 10 and 11) to a fixed frame 147, 147*a*, mounted on the machine framework 148. As shown in FIGS. 5, 10, 11 and 13, the fixed frame 147, 147*a* is mounted at the front right hand corner of the framework 148.

Associated with the legend imprinter L is the gate mechanism G (see FIGS. 9–11 and 13–15) comprising a gate member 150 secured to an oscillatable mounting bar 151 extending crosswise of the horizontal conveyor H; and a rotary solenoid 152 carried by the fixed frame member 147*a*. On the shaft 153 of the solenoid the gate mounting bar 151 is secured by a set screw 154 (FIG. 14). The opposite end of the mounting bar 151 is pivotally mounted in a bearing on the frame member 155 (FIGS. 9, 13 and 14).

Figure 15:
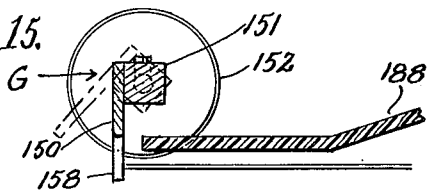
FIG. 15 is a section taken on the line 15—15 of FIG. 14.

Rotation of the solenoid 152 in a clockwise direction as viewed in FIG. 11 — counterclockwise as viewed in FIG. 15 — oscillates the gate member 150 to its vertical normally-closed position, and rotation of the solenoid in the opposite direction oscillates the gate member 150 to its open position as indicated in dot-and-dash lines in FIG. 15. Adjustment of the gate to its vertical position is afforded by the set screw 154 and squareness of the gate with the print-aligning guide member A of the horizontal conveyor H may be adjusted by adjusting the position of member 155 on member 156.

Figure 13:
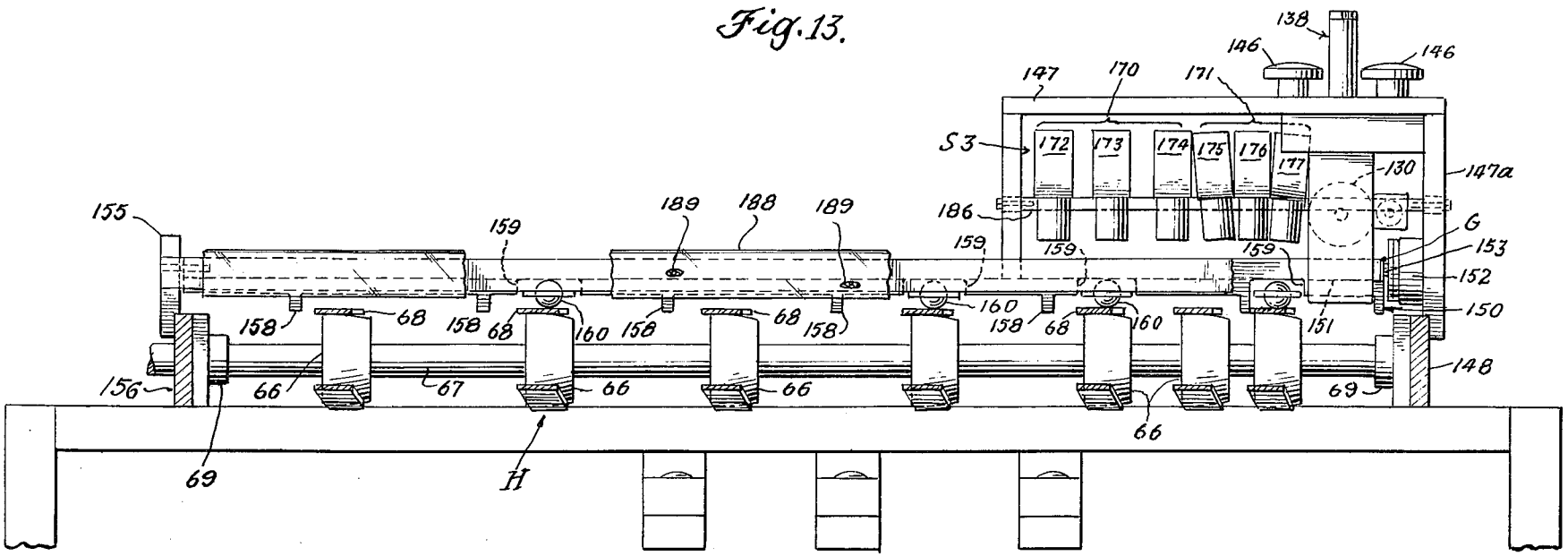
FIG. 13 is a cross section taken on the line 13—13 of FIG. 11 with certain parts broken away to show other parts more clearly.
Figure 14:
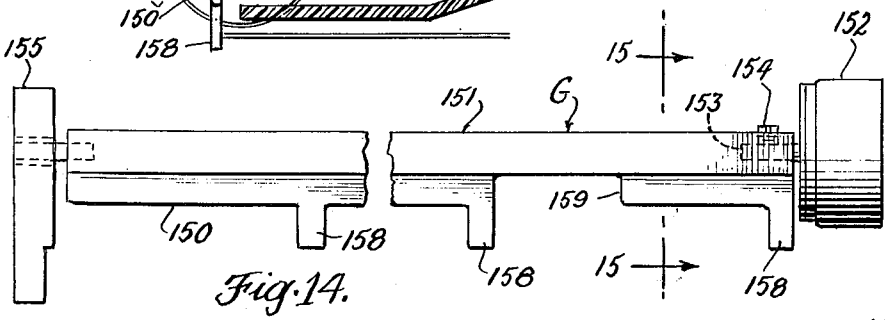
FIG. 14 is a detail view of the gate appearing in FIG. 13, but partially broken out to shorten the Figure.

The gate member 150 is provided with a plurality of depending protrusions 158, spaced longitudinally, so as to lie between the belts 68 of the horizontal conveyor as seen in FIG. 13, and with a plurality of notches 159 to enable the gate in its opening movement to clear a plurality of adjacent hold-down balls 160 which aid in causing the leading edge of each print to bear upon the belts 68 so as to ensure that the prints released by the gate will be thrust into the folding machine F.

Also associated with the imprinter L is the classification index scanner S3 which (as seen from FIGS. 2, 5, 9–11, 13 and 16) comprises two groups 170 and 171 of photoelectric scanners, the group 170 having three scanners 172, 173 and 174 for scanning the index areas of full-size prints such as B, C, D and E above referred to, and the group 171 having three scanners 175, 176 and 177 for scanning the index areas of half-size prints, for example, prints of 11 inches × 17 inches size and 17 inches × 22 inches size, and/or other reduced sizes.

In connection with the scanning of the prints for imprinting legends or the like thereon, it is pointed out that index marks are placed on the engineering tracings at specified points according to certain pre-selected categories of tracings, and these marks are transferred to the prints as a dense index mark in the printing process, while in the printer P. For example, referring to FIGS. 2 and 16, index marks for selectively imprinting any of three legends on a full-size print would be placed on the tracing at points 180, 181 and 182, respectively.

Similarly, index marks for selectively imprinting first, second and third legends on reduced-size prints would be placed on the tracings at the usual points, but will appear (on the reduced intermediate, if any) and on the half-size prints at points 183, 184 and 185.

The three scanners 172, 173 and 174 are mounted on a support bar 186 of the frame 147 so as to be in line with the three index marks 180, 181 and 182; and the three scanners 175, 176 and 177 are mounted on the support bar 186 so as to be in line with the three index marks 183, 184 and 185, when prints pass, properly aligned, therebeneath.

Before proceeding with particular operations dealing respectively with B-size, C-size, D- and E-size prints, certain general controls will be briefly described. The control console 116, mounted on the framing of the conveyor mechanism CM is preferably supplied with power-on and power-off switches, controlled by push-buttons $Y^1$ and $Y^2$, for controlling the motor M and thus the conveyor mechanism.

The control console 192, mounted on the framing of the folding machine F, is preferably supplied with "on" and "off" switches controlled by pushbuttons $Z^1$ and $Z^2$ for independent starting and stopping of the folding machine F, which may have its own power unit (as disclosed in said co-pending application 737,934). Alternatively, the folder and other portions of the system, e.g., the conveyor, may take power from a common drive source, such as the motor M.

For the convenient joint operation of the conveyor mechanism and the folding mechanism, either console (in this case, the console 116) is provided with a joint, or overriding control, in the form of switches operated by "on" and "off" pushbuttons $J^1$ and $J^2$. Overriding this, in turn, is the timer T (previously mentioned), operating to shut down the system, after a pre-selected time interval between the passage of prints out of the printer P onto the conveyor mechanism, and operating to start up the system again when another print emerges from the printer.

An additional overriding control, comprising a manually operated switch X is preferably mounted on the framing of the printer P, closely adjacent to the feed table 45, so that an operator, standing at that point, and delivering tracings and paper into the printer, can press the control X and shut down the entire system quickly, in the event he sees anything out of order in the operation of any part of the system.

Each console may be provided with "mode" controls, for setting the subject mechanism for operation automatically or manually. Or the conveyor mechanism CM and the folder F may both be simultaneously conditioned, as to mode, by button-controlled switches on one console. Thus, as herein shown, the console 116 has a modeswitching device controlled by the interlocked buttons AC (for automatic control mode) and MC (for manual control mode).

Assuming now that the AC button (for automatic control mode) has been pressed, the processing of a sheet will now be described.

If a B-size print, having an index mark 180 thereon, is to be processed, and the "on" buttons $Y^1$ and $Z^1$ are pressed, or else the system "on" button $J^1$, the B-size tracing and sheet of print paper are placed on the printer feed table 45 in alignment with the table guide-line 46, with the title block 44 of the tracing forward after which they are fed into the printer P for printing.

The print, upon emerging from the outlet at the rear of the printer, enters the throat of the inclined conveyor I and passes on, via conveyor H to and through the folder F. It is here noted that if, at the expiration of the time interval setting of the timer T, associated with the scanner S1, a succeeding print has not interrupted the light beam the system will be shut off and will automatically start up again when the next print intercepts the light beam.

The print progresses down the inclined conveyor I onto the horizontal conveyor H and travels therealong to the gate mechanism G where it is stopped by the gate 150, which is normally closed by a spring embodied in the rotary solenoid 152 of the gate. The print is guided at this point by a guide member 188 (FIGS. 10–15) preferably of "Plexiglas" transparent sheet or other plastic. This guide member is provided with three retro-reflective buttons 189 located above and in alignment with the three photoelectric relays R1, R2 and R3 (FIGS. 1, 2 and 12). The guide member 188 is also provided with six see-through holes 190 for the six index scanners 172–177, located in registry with the scanners.

With the print in its stopped position, the index mark 180 of the print is directly under the photoelectric scanner 172 and the print itself covers the reflex photoelectric relay R1 to interrupt its light beam, which thus detects the presence of the B-size print and effects automatic set-up of the proper folding program for the B-size print by actuation of a switch controlled by the pushbutton 191 (FIGS. 3 and 4). As heretofore stated, the button (with its switch) is mounted in a console 192. When operating by automatic control, it is actuated by a solenoid 193 the core 194 of which is connected to the bottom of the push-button switch 191 by a link 195. Such actuation of 191 closes an electric circuit that conditions the first folding unit 80 of the folding machine F to fold the B-size print into an 8½ inches × 11 inches packet and route it to, and deposit it in, the rear stacking tray 84.

As mentioned just above, the index mark 180 of the print is directly under the photoelectric scanner unit 172 of the sheet identifying device S3 so that the scanner unit 172 looks at the index mark 180 through a hole 190 in the print guide 188 to condition the imprinter L to imprint the proper label on the print. It is noted that the print is held at rest by the gate until automatic classification index recognition and imprinting are accomplished. Upon completion of the imprinting cycle, the rotary solenoid 152 of the gate opens the gate to release the held print for advance under the feed balls 160 so that the moving belts 68 will thrust the print into the folding machine. Opening of the gate is influenced by the timer 187 (FIG. 2) which introduces a timed pulse through the relay of the classification index scanner 172.

Recognition of the classification index mark 180, through the medium of an electrical circuit, admits pressure fluid to the piston and cylinder device 138 of the imprinter L (FIGS. 17–20) to move the carrier 135 and imprint head 130 downwardly in full stroke to the position 130*a* (indicated in FIG. 17), it being noted that as the head so moves it is rotated in a counter-clockwise direction by the pinion 139 and rack 140 until a stop 200 of the head engages a fixed stop pin 201 of the carrier 135 to stop the head in its fully indexed position. In this rotary movement of the imprint head, the printing block 131, as it passes the inking roller 134, is inked, and when the head reaches its fully indexed position the printing block imprints its legend or mark on the print (here indicated as print B). In this indexed position of the head a microswitch 202 (FIG. 18) is closed, so as to actuate the electric circuit so as to return the imprinting head 130, thus causing the head to rotate in a clockwise direction past the inking roll 134 for reinking, and to its upper rear position (FIGS. 17 and 18). Simultaneously, upon closing this switch 202, the circuit causes the gate rotary solenoid 152 to be energized, to open the gate 150, thus enabling the imprinted print to be thrust into the folding machine F by the belts 68, under the pressure of the feed balls 160.

Referring now to the processing of a C-size print, it will be seen from FIG. 2 that, when the C-size print reaches its stopped position at the gate 150, the light beams of both of the reflex photoelectric scanners R1 and R2 are interrupted, thus detecting the presence of the C-size print and effecting automatic set-up of the proper folding program for the C-size print by actuation of a solenoid 205 of a C-size pushbutton switch 206 of the console 192 (FIG. 3). Actuation of the pushbutton switch 206 closes a circuit that conditions the second folding unit 90 of the folding machine F to fold the C-size print into an 8½ inches × 11 inches packet and route it to, and deposit it in, the side tray 97.

Assuming now that the C-tracing has been provided with an index mark 181 (FIGS. 2 and 16), this index mark, when the C-size print is in stopped position at the gate 150, will be directly under the photoelectric scanner 173 of the classification index scanner S3 so that the scanner looks at the index mark 181 to condition the imprinter L to imprint the proper legend on the print. Recognition of this index mark admits fluid pressure to the piston and cylinder device 138 of the imprinter L to cause downward movement of the carrier 135 and imprint head 130. At the same time a pneumatic stop 210 (FIG. 13) is extended into the path of the stop 200 of the head to stop rotation of the head by the pinion 139 and rack 140 in a position so the middle printing block 132 of the head will imprint its legend or mark on the C-size print when the imprint head 130 is at the bottom of its printing stroke.

In this connection it will be observed that rotation of the head 130 has been impeded by the pneumatically-operated stop 210 before the head has reached the limit of its down or printing stroke. The shaft 137 of the head is provided with a pin 211 operating in a slot 212 of the head which enables the shaft to continue in its rotation, although only the rotation of the head has been stopped. A torsion spring 213 (FIG. 18), interposed between the head 130 and pinion 139, normally maintains the pin 211 in yieldable engagement with the slot 212 and winds up, so to speak, during the remainder of the down stroke of the head. After imprinting of the insignia on the C-size print, the operation is the same as described above in connection with the B-size print.

Referring now to the processing of a D-size or E-size print, it will be seen from FIG. 2 that, when the prints reach their stopped positions at the gate 150, the light beams of all three reflex photoelectric scanners R1, R2 and R3 are interrupted, thus detecting the presence of a D- or E-size print and effecting automatic set-up of the proper folding program for the prints by actuation of a solenoid 215 of the D- E-size pushbutton switch 216 of the console 192 (FIG. 3). Actuation of the pushbutton switch 216 closes a circuit that conditions the third folding unit 100 of the folding machine to fold the prints into 8½ inches × 11 inches packets.

Assuming now that an E-size tracing has been provided with an index mark 182 (FIGS. 2 and 16), this index mark, when the print is in stopped position at the gate 150, will be directly under the photoelectric scanner 174 of the classification index scanner S3 so that the scanner looks at the index mark 182 to condition the imprinter L to imprint the proper legend on the print. Recognition of this index mark admits fluid pressure to the piston and cylinder device 138 of the imprinter L to cause downward movement of the carrier 135 and imprint head 130. At the same time, a pneumatic stop 217 is extended into the path of a stop 218 of the head to stop rotation of the head by the pinion 139 and rack 140, in a position so that the printing block 133 of the head will imprint its legend on the print when the imprint head is at the bottom of its stroke as shown in FIG. 20. The pin 211, slot 212 and torsion spring 213 function the same as described above in connection with the C-size print. After imprinting of the legend the operation is the same as described above in connection with the B-size print.

Figure 16:
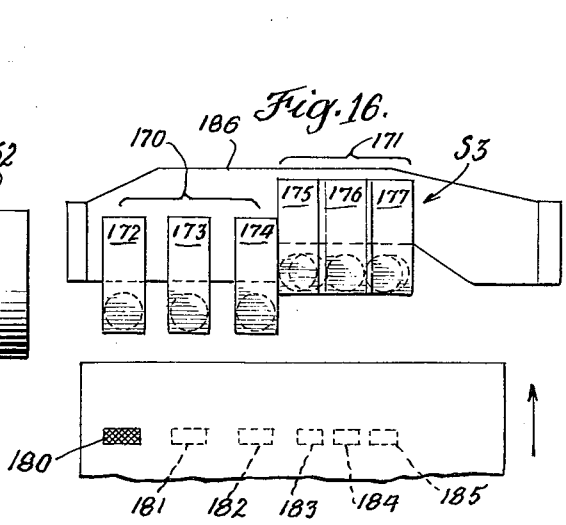
FIG. 16 is a plan view of a scanning unit employed in the equipment.

The system is also adapted to process prints of one-half the size of the D-size and E-size prints, with smaller title blocks, and on which the legend may be imprinted on the prints at a different location from the full-size prints. It is pointed out that a print one-half the size of a D-size print in effect is the same size as a B-size print and a print one-half the size of an E-size print in effect is the same size as a C-size print. Therefore, the manner of selecting the proper folding programs for them is the same as described above in connection with the B- and C-size prints and need not be repeated. However, if the legend is to be imprinted at a different location on the print, the location of the imprinter L must be adjusted accordingly. It is also pointed out that the classification index scanners 175, 176, 177 for the half-size prints are, in this case, positioned on the frame 147 closer to the edge guide A then are the scanners 172, 173 and 174 (as shown in FIGS. 2, 13 and 16) and that the three index marks are correspondingly placed on the tracings as shown at 183, 184 and 185.

Referring to FIG. 10, adjustment of the position of the imprinter may be accomplished by loosening the thumb screws 146, 146, and shifting the imprinter assembly L in the arcuate slots 219 thus positioning the imprinter head 130 at the position indicated at 130*b*. An elongated slot 220 is provided in the frame 137 to guide the imprinter in making the adjustment. With the imprinter in its adjusted position a micro-switch 221 is closed which disconnects the three full-size-print scanners 172, 173 and 174 and connects the half-size-print scanners 175, 176 and 177 for actuation of the imprinter in the same manner as above described for full-size prints.

Overall sensitivity of the scanner system can be adjusted by raising or lowering the support bar 186 of the scanners so as to adjust the focus of the scanner light beams. A smaller spot of light represents better focus and thus better reflection of light and greater sensitivity.

In FIG. 21 an alternative form of imprinting assembly is illustrated, comprising three imprinting heads 211, 222 and 223 secured to a pivoted bracket 224, and actuating rod 225 connected to the bracket by a pin 226. In the position shown in FIG. 21 the central imprinter head 222 is in printing position, and when the bracket 224 is rocked to the right imprinter head 221 is brought into printing position, and when rocked to the left imprinter head 223 is brought into printing position. When employing this form of imprinter, the actuating rod 225 is operated through an electrical circuit under control of the classification index scanner S3.

The electrical circuits (with relays, and other usual elements of electrical control and operating circuits, where needed) are not illustrated in the drawings, since they make take any suitable form adapted to provide the needed functional inter-relation between sensors, switches, timers, and various controlling devices as illustrated herein (on the one hand) and the actuated, connectable, timed and controlled devices as illustrated herein (on the other hand); and since such electrical elements are commercially available they are not deemed to be patentable features herein.

It is believed that the detailed description and illustration of the present preferred system will make clear how the objects and advantages of the present invention may be most fully attained. It may be added, however, that most, if not all, of the functions of the various elements of the equipment may be carried out manually (when necessary or desired), although the greatest benefits of the invention are secured when employing automatic and substantially continuous operation. Thus, after an operator has once set the equipment for automatic operation and turned it on, he need only feed the print paper and tracings into the printer P, whereupon the system automatically makes and indexes the print, conveys and positions it, senses the type and size of prints, selects the proper folding units of the folding machine for folding any random intermix of print sizes into packets of given size, imprints the proper data onto the print being processed, and routes and stacks the packets.

While the disclosure includes alternative forms of only the marking or imprinting mechanism, it will be understood that alternative forms of various of the other components of the equipment may be used in the novel systems herein claimed. Just for example, and not by way of limitation, in place of sensing or recognition devices of retro-reflective or photoelectric types, it would be possible to employ fluidic sensors, sensitive switches, or other devices. Accordingly, the disclosure and claims hereof are to be given the broadest meaning and scope feasible within the limitations of the prior art.

I claim:

1. A continuous automatic print system for making prints and for folding the prints comprising a printing machine for making prints of different sizes, having an exit opening for the prints, a print folding machine having means for folding the prints, irrespective of size, into packets of uniform size, said folding means including a plurality of selectively operable folding units; conveyor means for conveying the prints from the exit opening of the printing machine to said folding machine along a conveying path, means for sensing print size along said conveying path in advance of any of said folding units, and means coupled with a plurality of said folding units and operated by the sensing means to selectively actuate said folding units so as to fold successive prints irrespective of size into packets of uniform size.

2. A continuous automatic print system in accordance with claim 1 in which said print size sensing means comprises a plurality of photo-electric scanners spaced apart transversely of said conveyor means.

3. A system in accordance with claim 1 and further including automatic means for stopping said conveyor means after a predetermined time following the feeding of a print thereto if a succeeding print has not by then reached the conveyor means.

4. A system in accordance with claim 3 with an adjustable timer.

5. A system in accordance with claim 4 and further including a print sensing device associated with said timer adapted to start said conveyor means after the timer has timed out when a print is next delivered to the conveyor means.

6. An automatic sheet-processing system having conveyor means establishing a sheet feed path and adapted to handle an intermix of foldable flexible sheets of different sizes, successively, including sheet folding apparatus having an entrance and having, at its entrance, sheet receiving means for successively receiving sheets of different sizes, and having, in the feed path downstream of said receiving means, means for folding sheets irrespective of size, into packets of uniform standardized length and width dimensions, the folding means including a plurality of selectively operable folding units; the conveyor means including feed mechanism in advance of said sheet receiving means for aligning successive sheets of different sizes and for feeding them to said receiving means of the folding apparatus; and sensing means establishing a sensing zone located along the sheet feed path in advance of said sheet receiving means, the sensing means being coupled with a plurality of said folding units and responsive to sheets of different sizes as they are successively fed through said sensing zone past said sensing means to the sheet receiving means to selectively subject the sheets to the action of one or more folding units of said folding apparatus to fold successive sheets, irrespective of size, into such packets of uniform standardized length and width dimensions.

7. The system of claim 6, having sheet-printing equipment operative to deliver feed printed sheets of different sizes, for folding by said folding apparatus.

8. The system of claim 7, wherein the sheet-printing equipment acts as part of the conveyor means for transporting the printed sheets from said printing equipment, through said sensing zone, to the sheet-receiving means of the folding apparatus.

9. The system of claim 8 with means for coordinating the operation of said printing equipment and said conveyor.

10. The system of claim 8 having independently-operatable controls for said printing equipment, said conveyor and said folding apparatus.

11. The system of claim 10 with means for coordinating said independently-operatable controls.

12. The system of claim 6 having independently-operatable controls for said feed mechanism and said folding apparatus.

13. The system of claim 12 with another control for riding over said independently-operatable controls.

14. The system of claim 6 with means for coordinating the operation of said feed mechanism and said folding apparatus.

15. In a system employing apparatus for printing sheets from reproducibles of different categories and also employing labelling means and sheet-folding mechanism, the method of processing foldable sheets of varying proportions, which includes: successively printing the sheets from such reproducibles and indexing each sheet, as printed, in accordance with the category of the reproducible from which it was made, passing the printed and indexed sheets successively through a sheet-scanning zone to a sheet-folding work station, utilizing the presence of a sheet in said zone to program the operation of the sheet-folding mechanism in accordance with the proportions of the particular sheet as determined in said scanning zone, so as to produce printed and folded sheet packets of uniform predetermined length and width regardless of the initial proportions of the successively printed sheets, also scanning such sheet as to its index and utilizing its index to activate the sheet labelling means to impose on the sheet a legend consistent with the category index.

16. The method of processing a foldable sheet, which includes: passing the sheet through a print machine; sensing the sheet, as it emerges from the print machine, for actuation of a conveyor; simultaneously conveying and aligning the sheet for delivery into a sheet-folder; scanning the sheet, after alignment, for recognition of predetermined characteristics of the sheet; arresting the sheet and applying marking to the sheet in conformity with certain of its characteristics as found by the scanning; delivering the scanned and marked sheet into the sheet-folder; and discharging the sheet, as a folded packet, to a receiving station.

17. A continuous automatic print system for making prints varying in size, for applying various information thereto, and for folding the prints into packets of a predetermined size; comprising a printing machine having a feed entrance for print paper and a reproducible and having an exit opening for the prints; a print folding machine; automatic conveyor means for feeding prints from the exit opening of the printing machine to said folding machine; information applying mechanism associated with said conveyor means for applying selectively different information on different prints; said print folding machine having a plurality of selectable folding units for folding prints of various sizes to a predetermined size; means for automatically actuating said applying mechanism to apply the selected information on different prints; and selector means for automatically actuating said selectable folding units of the folding machine in accordance, with the size of print being processed.

18. The system of claim 17 having scanning means for scanning the prints to selectively actuate said folding units.

19. A system in accordance with claim 18 and further including means for holding a print at rest at least during the application of information on the print.

20. A system in accordance with claim 19 and further including means for releasing said holding means automatically after completion of the said application of information.

* * * * *